US010329136B2

(12) United States Patent
Achatz et al.

(10) Patent No.: US 10,329,136 B2
(45) Date of Patent: Jun. 25, 2019

(54) FILLING ADAPTER (CLAW ANGLE ADJUSTMENT)

(71) Applicant: DÜRR SOMAC GmbH, Stollberg (DE)

(72) Inventors: Thomas Achatz, Niederdorf (DE); Eric Selbmann, Gersdorf (DE); Frank Wieland, Burkhardtsdorf (DE)

(73) Assignee: DÜRR SOMAC GmbH, Stollberg (DE)

( * ) Notice: Subject to any disclaimer, the term of this patent is extended or adjusted under 35 U.S.C. 154(b) by 257 days.

(21) Appl. No.: 15/129,729

(22) PCT Filed: Mar. 18, 2015

(86) PCT No.: PCT/DE2015/000136
§ 371 (c)(1),
(2) Date: Sep. 27, 2016

(87) PCT Pub. No.: WO2015/149736
PCT Pub. Date: Oct. 8, 2015

(65) Prior Publication Data

US 2017/0137276 A1 May 18, 2017

(30) Foreign Application Priority Data

Mar. 29, 2014 (DE) ..... 10 2014 004 823

(51) Int. Cl.
*B67D 7/02* (2010.01)
*B67D 7/06* (2010.01)
(Continued)

(52) U.S. Cl.
CPC ..... *B67D 7/0288* (2013.01); *B67D 7/02* (2013.01); *B67D 7/04* (2013.01); *B67D 7/06* (2013.01); *B67D 7/42* (2013.01)

(58) Field of Classification Search
CPC ..... B67D 7/0288; B67D 7/02; B67D 7/04; B67D 7/06; B67D 7/42
See application file for complete search history.

(56) References Cited

U.S. PATENT DOCUMENTS 5,095,962 A * 3/1992 Lloyd-Davies ..... B67D 3/045 141/114
6,070,624 A * 6/2000 Bilbrey ..... B67D 1/0829 137/625.19

(Continued)

FOREIGN PATENT DOCUMENTS

| | | | |
|---|---|---|---|
| CN | 102758977 | A | 10/2012 |
| DE | 7833183 | U1 | 9/1987 |
| EP | 1538125 | A1 | 6/2005 |

OTHER PUBLICATIONS

International Search Report (English and German) for PCT/DE2015/000136, ISA/EP, Rijswijk, NL, dated Oct. 5, 2015.

(Continued)

*Primary Examiner* — Nicolas A Arnett
(74) *Attorney, Agent, or Firm* — Harness, Dickey & Pierce, P.L.C.

(57) ABSTRACT

A filling adapter for a container to be filled with media, in particular for the filling of containers on assembly lines for the production of motor vehicles where the filling adapter is equipped with a hose pack, electrical, pneumatic, and hydraulic lines. The filling adapter is equipped with a clamping drive housing with a stationary part and a receiving part for clamping claws. The receiving part can be operatively connected with a union nut such that, after loosening the union nut, the position of the clamping claws can be rotationally adjusted, allowing rotation of the filling adapter with respect to the container to be filled. A clamping (Continued)

drive housing includes a toothing, with which the receiving part for the clamping claws engages by way of a locking pin.

2 Claims, 1 Drawing Sheet

(51) Int. Cl.
*B67D 7/42* (2010.01)
*B67D 7/04* (2010.01)

(56) References Cited

U.S. PATENT DOCUMENTS 6,612,545 B1 * 9/2003 Rutter ..... B65D 77/067 141/346
6,702,337 B2 * 3/2004 Rutter ..... B65D 77/067 285/362
6,981,534 B2 * 1/2006 Williams ..... B65B 3/045 141/346
8,196,621 B2 * 6/2012 Johnson ..... B67D 1/0082 141/372
8,479,785 B2 * 7/2013 Johnson ..... B67D 1/0082 141/372
8,517,061 B2 * 8/2013 Johnson ..... B67D 1/0082 141/10
8,578,979 B2 * 11/2013 Johnson ..... B67D 1/0082 141/2
9,862,588 B2 * 1/2018 Johnson ..... B67D 7/0294
2004/0256424 A1 * 12/2004 Johnson ..... B65D 77/067 222/518
2008/0053568 A1 * 3/2008 Johnson ..... B67D 1/0082 141/383
2012/0222775 A1 * 9/2012 Johnson ..... B67D 1/0082 141/353
2013/0105037 A1 5/2013 Frenal et al.

OTHER PUBLICATIONS

Written Opinion of the ISA (German) for PCT/DE2015/000136, ISA/EP, Rijswijk, NL, dated Oct. 5, 2015.

* cited by examiner

FILLING ADAPTER (CLAW ANGLE ADJUSTMENT)

CROSS-REFERENCE TO RELATED APPLICATIONS

This application is a national Phase of PCT International Application PCT/DE2015/000136 filed on Mar. 18, 2015. This application claims the benefit of and priority to German Patent Application No. 10 2014 004 823.3, filed on Mar. 29, 2014. The entire disclosures of each of the above applications are incorporated herein by reference.

FIELD

The disclosure relates to a filling adapter for a container to be filled with media (e.g. oils, gases, coolants and the like), in particular for the initial filling of containers with operating substances on assembly lines for the production of motor vehicles, wherein the filling adapter is equipped with a hose pack, electrical, pneumatic and hydraulic lines.

BACKGROUND

This section provides background information related to the present disclosure which is not necessarily prior art.

Containers must be filled with liquids or gases for numerous technical applications. A typical application in this respect are motor vehicles where housings, circuits, equalizing reservoirs and the like have to be filled with fuel, lubricants, coolants, and other operating substances. In the manufacturing process, these vehicles must be filled, for example, with brake fluid, power steering fluid, coolant, refrigerant, windshield wiper fluid, and fuel. These media are fed via hoses and special adapters to the respective circuits of the vehicles. The hoses typically include multiple lines with different functions for vacuum application, back suction, filling, aerating, as well as for electrical cables.

To perform the filling, a worker has to bring the adapter and hose pack to the vehicle depending on the respective position of the filling station and connect it to the ports of the circuits to be filled. Clamping claws are frequently used for clamping the filling adapter to the vehicle container to be filled. It can happen that the claws have to be positioned at a specific angle to the container. This is influenced by the design of the container or the vehicle, in that for example lugs, protrusions or similar contours are formed on the container.

In the clamping actuator designs that are currently in use, the claws are fixed in their position during actuation. This means that the entire clamping actuator must be rotated relative to the filling adapter to adjust an angle. This technical solution has considerable disadvantages. For example, it requires extensive placement of intermediate plates. The entire design also requires some effort because multiple media and control lines must be rerouted. The design must always be adjusted to the specific conditions of use at the customer's premises. Only a fixed angle can be implemented. The design results in a heavy weight and requires relatively much space on the adapter, which impairs handling altogether. Extending the lever arm also affects the container because of the adapter weight. And finally the cost of manufacture is high. There is an obvious need for development due to these disadvantages.

SUMMARY

This section provides a general summary of the disclosure, and is not a comprehensive disclosure of its full scope or all of its features.

It is the purpose of the invention to configure the attachment of the claws on the clamping drive of a filling adapter such that it can be adjusted to different angular positions, and particularly in small increments, as desired.

This problem is solved in that the filling adapter is equipped with a clamping drive housing consisting of a stationary part and a receiving part for clamping claws, wherein the receiving part can be brought into operative connection with a union nut so that after loosening the union nut, the position of the clamping claws can be rotationally adjusted such that the filling adapter can be rotated according to the container to be filled. To prevent the union nut from loosening, a toothing in which the receiving part for the clamping claws engages by way of a locking pin is configured in the clamping drive housing. This results in a finely graded angular adjustment of the claws.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
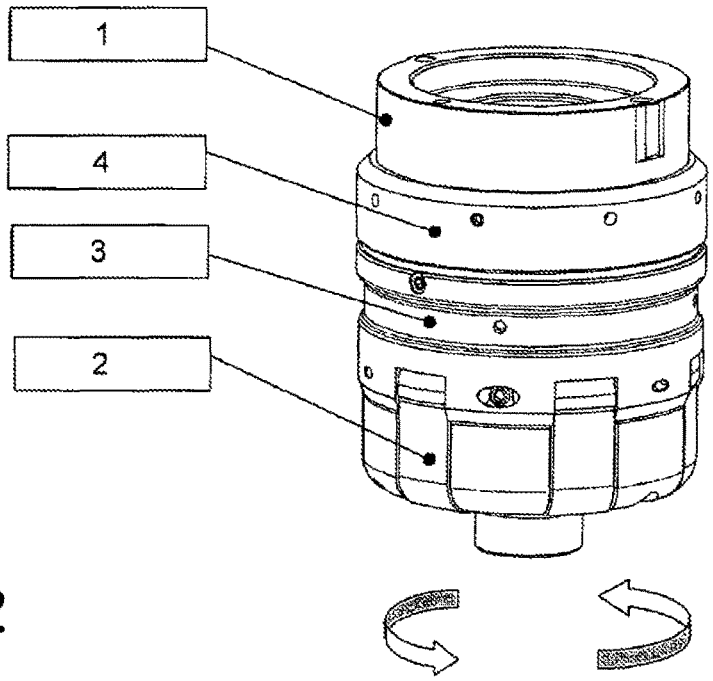
FIG. 1 shows the clamping system when the union nut is tightened.
Figure 2:
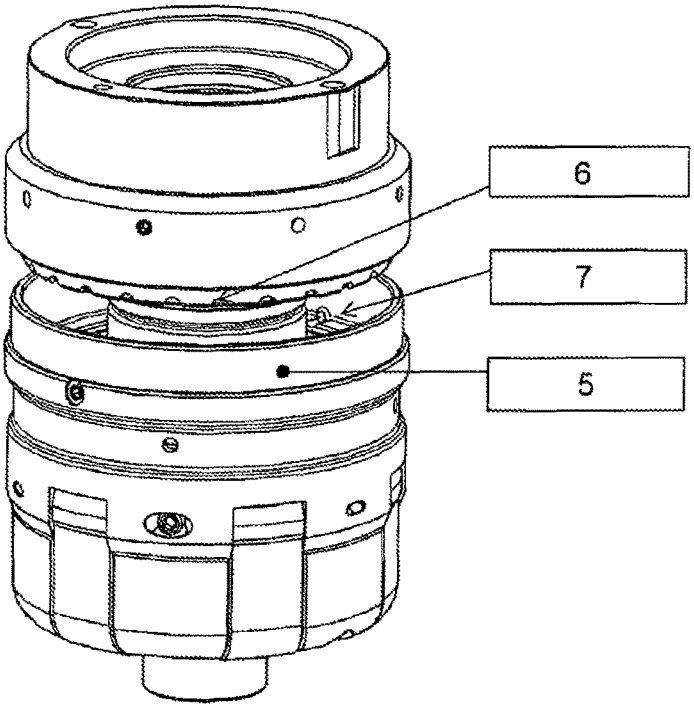
FIG. 2 shows the clamping system when the union nut is loosened.

A filling adapter according to the present disclosure is shown in FIGS. 1 and 2. The filling adapter is suitable for a container to be filled with media or operating substance, such as oils, gases, coolants and the like, during the initial filling of the container on an assembly line for the production of motor vehicles. Accordingly, the filling adapter comprises a clamping system including a clamping drive housing including a first, stationary part 1 and a second, rotatable receiving part 3 for the clamping claws 2. The receiving part 3 is connected to the stationary part 1 using a union nut 4, wherein the union nut 4 is guided in a threaded portion 5. Furthermore, the clamping drive housing is configured with a toothing 6 (e.g., a series of projections or teeth spaced apart by a pitch distance). The receiving part 3 for the clamping claws 2 engages this toothing 6 by means of a locking pin 7.

The receiving part 3 via the threaded portion 5 can be brought into operative connection with the union nut 4 so that after loosening the union nut 4, the position of the clamping claws 2 can be rotationally adjusted such that the filling adapter can be rotated to adapt to the container to be filled. Once tightened via the threaded portion 5, the union nut 4 can be prevented from loosening by way of the locking pin 7 engaging the toothing 6.

The filling adapter of the present disclosure enables the claws 2 on the clamping drive to be adjusted to different angular positions, and according to the pitch of the toothing 6, this can be achieved in particularly small increments, as desired. The filling adapter of the present disclosure results in a finely graded angular adjustment of the claws 2.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A filling adapter for initially filling containers with operating substances on assembly lines for the production of motor vehicles, wherein the filling adapter is equipped with a hose pack, electrical, pneumatic and hydraulic lines, wherein the filling adapter comprises a clamping drive housing comprising a stationary part and a receiving part for clamping claws, wherein the receiving part can be brought into operative connection with a union nut so that after loosening the union nut, the position of the clamping claws can be rotationally adjusted so that the filling adapter can be rotated according to the container to be filled, and wherein a toothing in which the receiving part for the clamping claws engages by way of a locking pin is configured in the clamping drive housing.

2. A filling adapter for a container comprising:

a first, non-rotatable part comprising a union nut and a toothing comprising a plurality of circumferentially arranged teeth spaced apart by a pitch distance; and a second, rotatable part comprising a plurality of clamping claws, a threaded portion and a pin;

wherein when the union nut is disengaged from the threaded portion, the second part is rotatable relative to the first part about a longitudinal axis of the filling adapter;

wherein when the second part is at a desired rotational position relative to the first part, the pin engages the toothing and the union nut engages the threaded portion such that the second part is rotationally fixed relative to the first part; and wherein the clamping claws are rotationally adjustable in discrete increments defined by the pitch distance to accommodate the container to be filled.

* * * * *